US009339162B2

(12) United States Patent
Gromes, Sr.

(10) Patent No.: US 9,339,162 B2
(45) Date of Patent: May 17, 2016

(54) METHOD FOR CLEANING SURFACES

(71) Applicant: TERYDON, INC., Navarre, OH (US)

(72) Inventor: Terry D. Gromes, Sr., Navarre, OH (US)

(73) Assignee: Terydon, Inc., Navarre, OH (US)

( * ) Notice: Subject to any disclaimer, the term of this patent is extended or adjusted under 35 U.S.C. 154(b) by 0 days.

(21) Appl. No.: 14/838,463

(22) Filed: Aug. 28, 2015

(65) Prior Publication Data

US 2015/0366426 A1 Dec. 24, 2015

Related U.S. Application Data

(62) Division of application No. 13/296,346, filed on Nov. 15, 2011, now Pat. No. 9,138,783.

(51) Int. Cl.

| | |
|---|---|
| ***A47L 11/40*** | (2006.01) |
| ***A47L 11/282*** | (2006.01) |
| ***B08B 3/02*** | (2006.01) |
| ***B08B 15/04*** | (2006.01) |

(52) U.S. Cl.

CPC ..... *A47L 11/4044* (2013.01); *A47L 11/282* (2013.01); *A47L 11/4083* (2013.01); *B08B 3/024* (2013.01); *B08B 15/04* (2013.01)

(58) Field of Classification Search

None

See application file for complete search history.

(56) References Cited

U.S. PATENT DOCUMENTS 6,151,748 A 11/2000 Earhart, Jr. et al.

*Primary Examiner* — Michael Kornakov
*Assistant Examiner* — Ryan Coleman
(74) *Attorney, Agent, or Firm* — Sand & Sebolt

(57) ABSTRACT

An apparatus and method for cleaning a surface. The apparatus includes a frame having wheels and a handle extending outwardly therefrom. A disc plate assembly is mounted on the frame for rotation about a first vertical axis and a nozzle assembly is mounted on the disc plate assembly for rotation about a second vertical axis. The disc plate assembly is rotated at a lower speed than the nozzle assembly. Separate pneumatically-operable motors drive the wheels, the disc plate assembly and nozzle assembly. A skirt extends downwardly from the frame and outwardly from nozzles on the nozzle assembly. The nozzles may be raised or lowered relative to the surface to be cleaned. Fluid is delivered from a fluid source to the nozzles and a vacuum port is provided on the frame to enable dirty fluid to be removed from a chamber bounded by the skirt.

19 Claims, 12 Drawing Sheets

METHOD FOR CLEANING SURFACES

CROSS-REFERENCE TO RELATED APPLICATIONS

This is a Divisional of U.S. patent application Ser. No. 13/296,346, filed Nov. 15, 2011, the entire specification of which is incorporated herein by reference.

BACKGROUND OF THE INVENTION

1. Technical Field

This invention relates generally to cleaning devices. More particularly, this invention relates to an apparatus for cleaning surfaces. Specifically, this invention is directed to a cleaning apparatus for washable surfaces that includes a disc plate assembly that rotates about a first axis and a nozzle assembly that rotates about a second axis at a higher speed and which delivers high pressure water jets from the nozzles of the rotating nozzle assembly.

2. Background Information

One of the issues that is experienced in industrial or manufacturing facilities, or in marine or military operations, is that substances may be deposited on surfaces and have to be removed. These surfaces include floors, walls, ceilings, domes, decks, and hulls, amongst others. The substances may include a wide variety of materials that may be extremely difficult to remove and may need to be contained and/or evacuated. Some of these substances could be materials such as non-skid on air carriers, lead-based paint, baked and built-up paint in automotive paint booths, refractory, build-up inside of boilers, chemical or polymer spills, coatings, paint, dust and debris in storage tanks in petrochemical plants, coatings and toxic material in nuclear facilities, etc There is therefore a need in the art for a cleaning machine that is capable of removing a variety of types of substances from a variety of surfaces.

BRIEF SUMMARY OF THE INVENTION

The present invention comprises an apparatus and method for cleaning a surface. The apparatus includes a frame having wheels and a handle extending outwardly therefrom. A disc plate assembly is mounted on the frame for rotation about a first vertical axis and a nozzle assembly is mounted on the disc plate assembly for rotation about a second vertical axis. The disc plate assembly is rotated at a lower speed than the nozzle assembly. Separate pneumatically-operable motors drive the wheels, the disc plate assembly and nozzle assembly. A skirt extends downwardly from the frame and outwardly from nozzles on the nozzle assembly. The nozzles may be raised or lowered relative to the surface to be cleaned. Fluid is delivered from a fluid source to the nozzles and a vacuum port is provided on the frame to enable dirty fluid to be removed from a chamber bounded by the skirt. The skirt may include one or more rows of brushes or bristles and/or rubber filaments.

The method includes the steps of activating the cleaning apparatus; rotating the wheels about a horizontal axis so as to move the cleaning apparatus linearly over a surface to be cleaned; rotating the disc plate assembly about a first vertical axis; rotating a nozzle head on the nozzle assembly about a second vertical axis; and delivering fluid from a remote fluid source to the nozzle head so as to spray the fluid over the surface to be cleaned.

The method further includes the steps of delivering air from a remote air source to a first motor mounted on the frame to rotate the wheels about the horizontal axis; delivering air from the remote source to a second motor mounted on the frame to rotate the disc plate assembly about the first vertical axis; and delivering air from the remote source to a third motor mounted on the frame to rotate the nozzle head about the second vertical axis.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
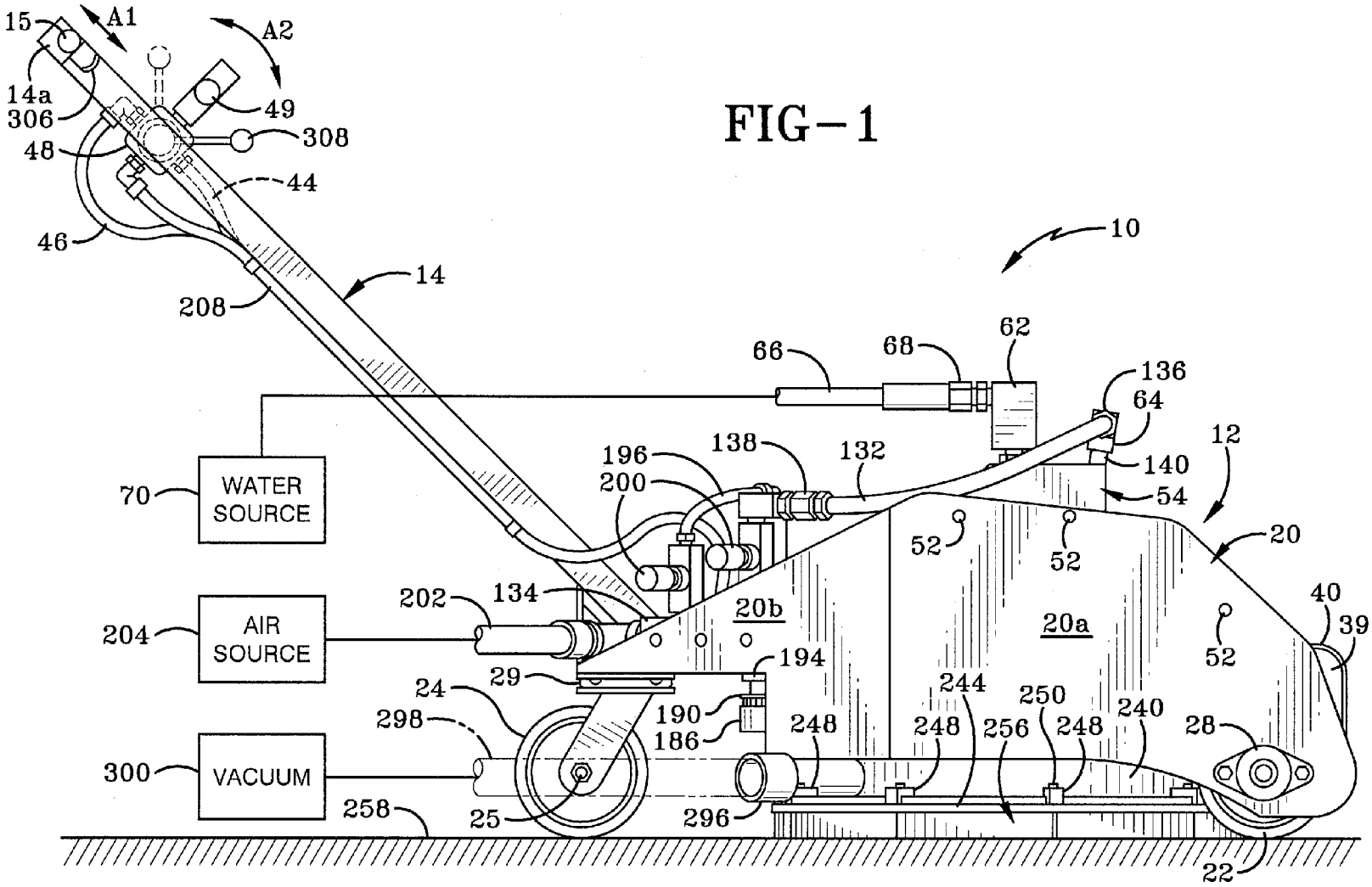
FIG. 1 is a side view of a cleaning apparatus in accordance with the present invention.
Figure 2:
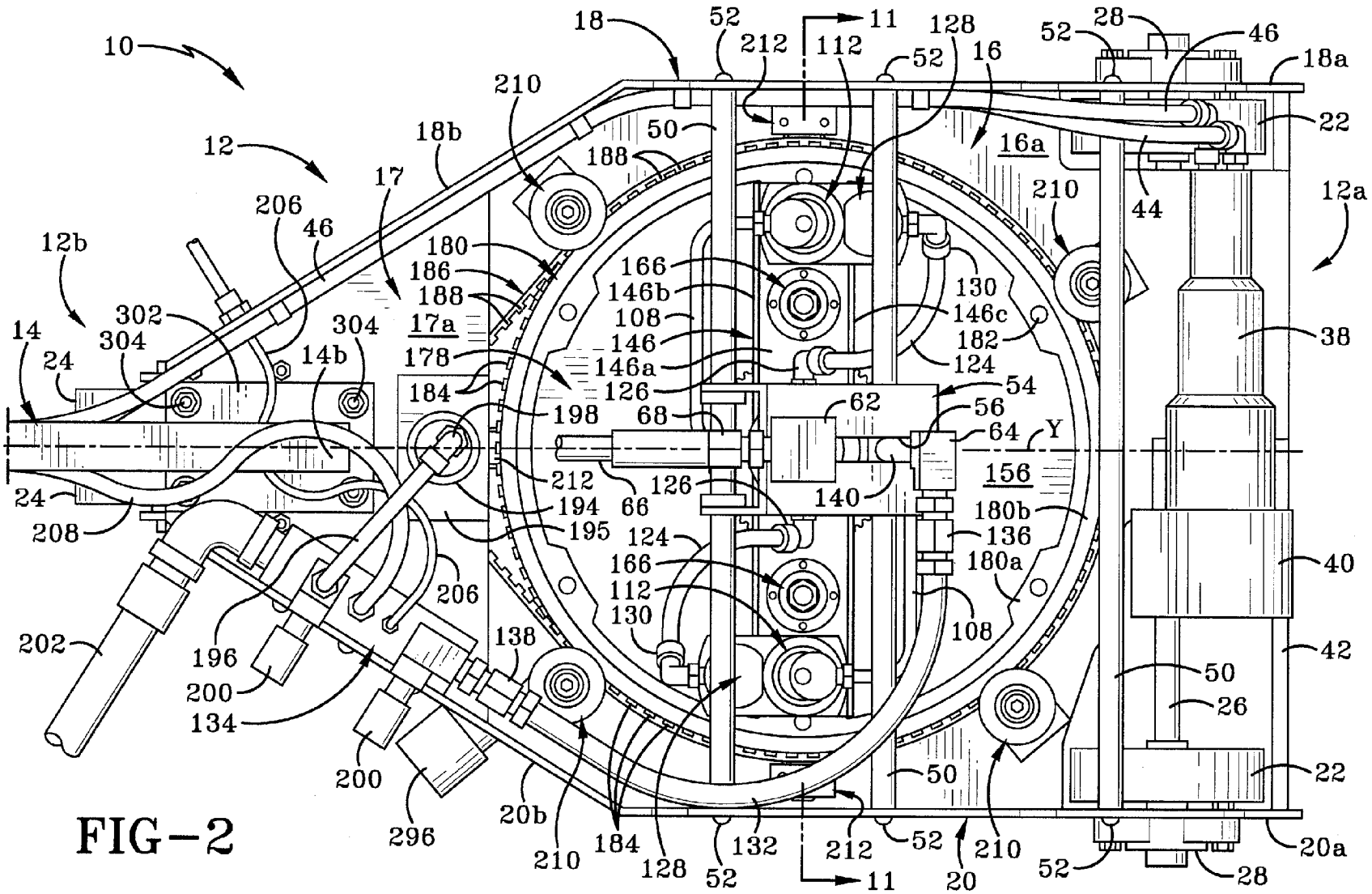
FIG. 2 is a top view of the cleaning apparatus which does not include a view of the handle.

Referring to FIGS. 1-12, there is shown a cleaning apparatus in accordance with the present invention, generally indicated at 10. Cleaning apparatus 10 comprises a housing 12 and a handle 14. Housing 12 has a front end 12*a* and a back end 12*b*. Housing includes a lower base plate 16 (FIG. 2), an upper base plate 17 and first and second side walls 18, 20. Lower base plate 16 has an upper surface 16*a* and a lower surface 16*b* and upper base plate has an upper surface 17*a* and a lower surface 17*b*. Upper base plate 17 is disposed a distance vertically above lower base plate 16 and a vertical wall 21 extends between upper and lower base plates 17, 16. First and second side walls 18, 20 extend upwardly from an upper surface 16*a* of base plate 16 and substantially at right angles thereto. Base plate 16 defines a generally circular aperture 16*c* (FIG. 3) therein which extends between upper and lower surfaces 16*a*, 16*b*. Each of the first and second side walls 18, 20 includes a first region 18*a*, 20*a* and a second region 18*b*, 20*b*. First regions 18*a*, 20*a* are disposed generally parallel to each other and parallel to a longitudinal axis "Y" of housing. (Longitudinal axis "Y" extends between front and back ends 12, 12*b* of housing 12.) Second regions 18*b*, 20*b* of first and second side walls 18, 20 are disposed at an angle relative to first regions 18*a*, 20*a* thereof and second regions 18*b*, 20*b* angle toward each other so that back end 12*b* of housing 12 tapers. Handle 14 has a top end 14*a* and a bottom end 14*b*. Bottom end 14*b* is mounted to upper base plate 17 by way of a mounting plate 302 (FIG. 2).

Housing 12 further includes a pair of front wheels 22 and a pair of back wheels 24. Front wheels 22 are mounted on a horizontally oriented axel 26 that extends between first and second side walls 18, 20. Axel 26 is fixedly engaged with front wheels 22 so that when axel 26 is rotated, front wheels 22 will be rotated. A bearing 28 is provided at either end of axel 26 so that front wheels 22 may rotate freely relative to first and second side walls 18, 20. Back wheels 24 are mounted on an axle 25 which is secured to a mounting plate 29 (FIG. 3) secured to lower surface 17*b* of upper base plate 17. Mounting plate 29 is able to rotate through 360 degrees. Back wheels 24 are therefore able to pivot through 360 degrees and this enhances the mobility of apparatus 10.

A first gear sprocket 30 is (FIG. 8) is fixedly engaged with axel 26 and a second gear sprocket 32 is operationally engaged with first gear sprocket 30 by way of a drive belt 34. Second gear sprocket 32 is fixedly engaged with a drive shaft 36 extending outwardly from a first motor 38 mounted on a mounting block 39 proximate front end 12*a* of housing 12. A shroud 40 is mounted to mounting block 39 and is disposed over first and second gear sprockets 30, 32 to protect the same. Additionally, a protective front guard rail 42 is disposed between first and second side walls 18, 20 to protect at least first gear sprocket 30 from accidental impact during use of apparatus 10. First and second air hoses 44, 46 are connected to first motor 38 by way of elbow fixtures 48. First and second air hoses 44, 46 extend from first motor 38 to a top end of handle 14 where they are engaged with a control valve 48. An adjustment valve 49 is operationally engaged with control valve 48. A trigger 306 is operationally linked to both of the control valve 48 and adjustment valve 49.

Housing 12 further includes three bracing members 50 which extend between first and second side walls 18, 20 and are secured thereto by way of fasteners 52. Bracing members 50 provide strength and rigidity to housing 12 and two of members 50 additionally act as supports for a stabilizing assembly 54. Stabilizing assembly is a generally rectangular member that has side walls 54*a*, 54*b* (FIG. 4) and a top wall 54*c*. Side walls 54*a*, 54*b* are spaced apart from each other and are secured to both of the two bracing members 50. A slot 56 is defined in top wall 54*c* and the slot 56 extends substantially parallel to a longitudinal axis "Y" (FIG. 2) of housing 12.

In accordance with a specific feature of the present invention, cleaning apparatus 10 includes a nozzle assembly which includes a primary water swivel 58 and an air swivel 60 (FIG. 9) are disposed below stabilizing assembly 54. A water inlet 62 and an air inlet 64 extend upwardly away from stabilizing assembly 54. A water hose 66 is connected to water inlet via a fitting 68 and the water hose 66 extends between water inlet 62 and a remote water source 70. Primary water swivel 58 includes a housing 72 having a first region 72*a*, second region 72*b* and third region 72*c*. First region 72*a* has a neck 73 that is operationally engaged with water inlet 62 via a fitting 63 (FIG. 11) which extends through slot 56 of stabilizing assembly 54. First region 72*a* defines a first bore 74 therein which is in operational communication with water hose 66 via water inlet 62. Second region 72*b* defines a second bore 76 therein and a portion of first region 72*a* is received in a part of second bore 76. One or more O-rings 78 are disposed between first and second regions 72*a*, 72*b*. Third region 72*c* defines a third bore 80 therein and a portion of second region 72*b* is received in part of third bore 80. An annular seal 82 is disposed between an upper zone of second and third regions 72*b*, 72*c*. Primary water swivel 58 further includes a water pipe 84 that extends upwardly into a lower zone of third bore 80 in third region 72*c*. Pipe 84 includes an uppermost end 84*a* that extends through second bore 76 and into first bore 74. One or more seals 86*a*, 86*b* and an O-rings 78 surround uppermost end 84*a* of pipe 84. A pair of spaced apart bearings 88 are disposed between pipe 84 and second and third regions 72*b*, 72*c* of housing 72. During operation of apparatus 10, bearings 88 permit pipe 84 to rotate within housing 72. A lowermost end 84*b* of pipe extends outwardly from housing 72.

Figure 5:
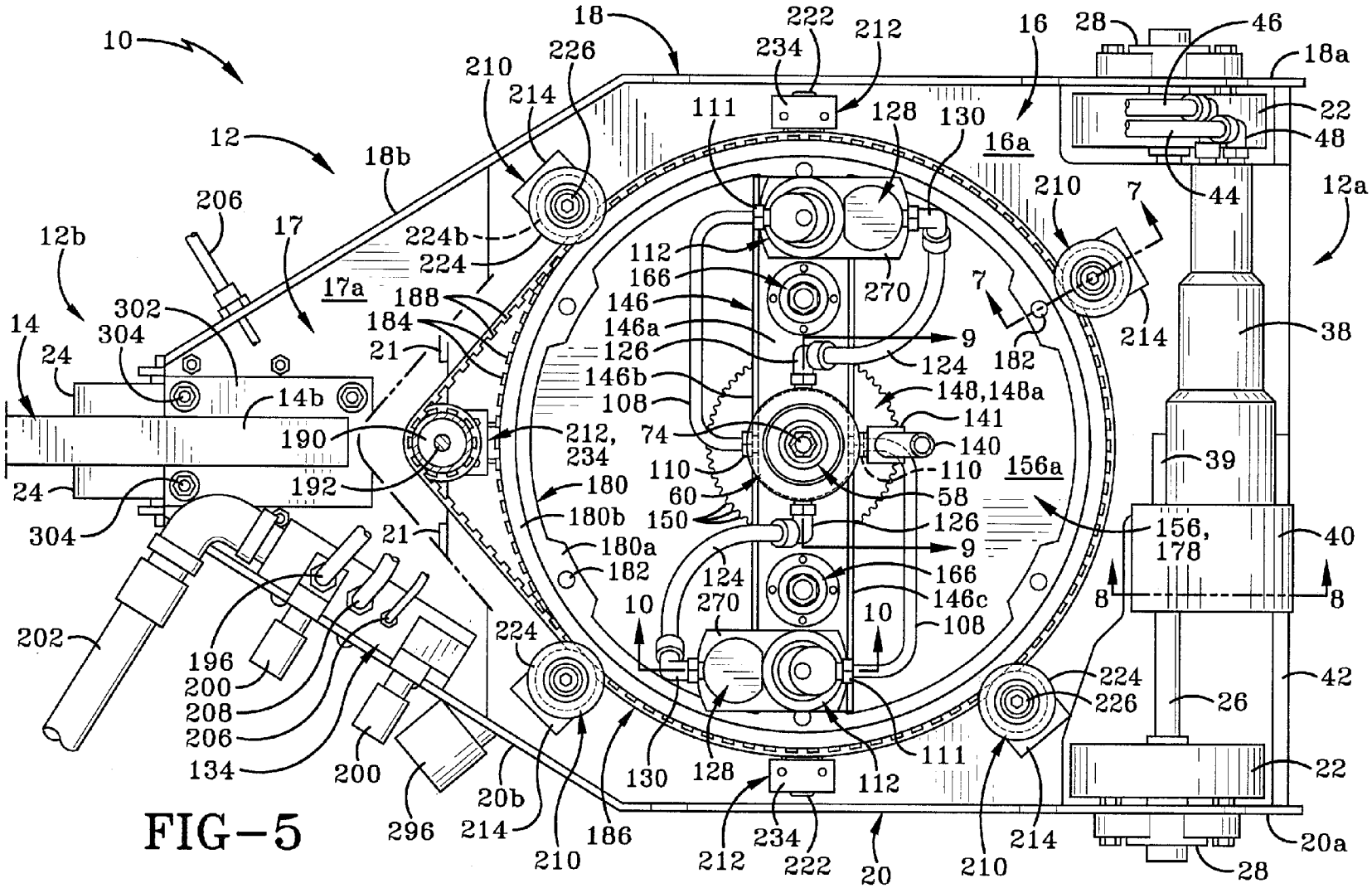
FIG. 5 is top view of the cleaning apparatus with the stabilizing assembly and the bracing members removed therefrom so as to reveal the structure therebeneath.
Figure 6:
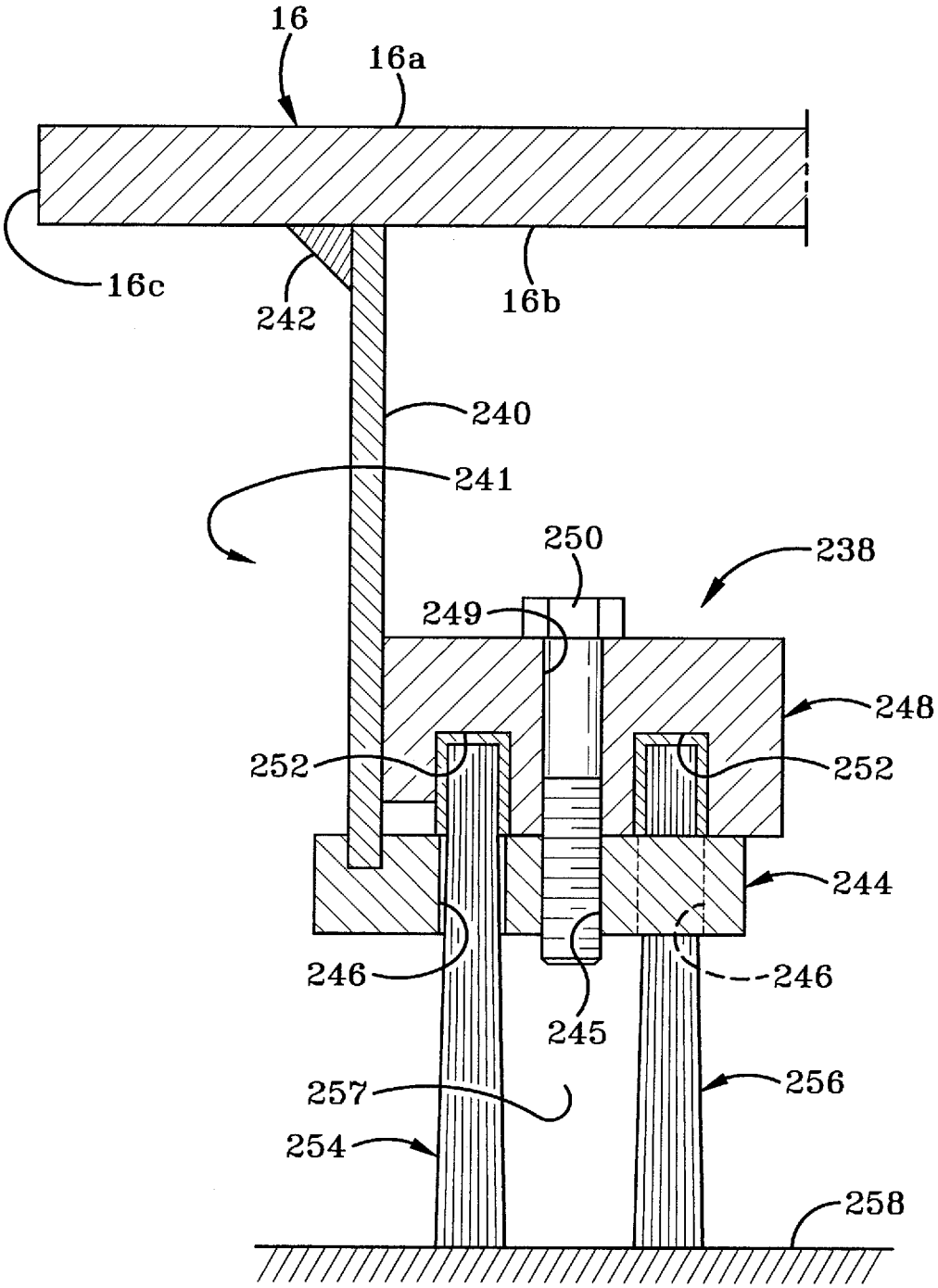
FIG. 6 is a cross-sectional view of the skirt taken through line 6-6 of FIG. 3.

As indicated previously, air swivel 60 is disposed beneath primary water swivel 58. Air swivel 60 includes a housing 90 comprising a first region 90*a* and a second region 90*b*. First region 90*a* defines a first bore 92 into which a portion of second region 90*b* is received. Two annular seals 94 and a plurality of O-rings 96 are disposed between first and second regions 90*a*, 90*b*. First region 90*a* further defines an annular groove 98 that is in communication with bore 92. Second region 92*b* defines three vertically oriented channels 100, 102, 104 that originate proximate an upper end thereof and extend for a distance into the interior of second region 92*b*. Channels 100, 102, 104 are substantially parallel to each other but channel 102 preferably is narrower than channels 100 and 104. Channel 102 includes a wider upper end 102*a* and a narrower lower end 102*b*. Upper end 102*a* tapers into lower end 102*b* and a secondary channel 103 extends outwardly from lower end 102*b* and is in fluid communication with a fitting 110 (FIG. 5).

A lowermost end 84*b* of pipe 84 is threadably engaged into upper end 102*a*. A seal 106 is provided in the upper end 102*a* of channel 102 to ensure that water flowing through pipe 84 and into channel 102 does not leak outwardly from housing 90. A pair of take-off pipes 108 is engaged with air swivel 60 via fittings 110. Pipes 108 are opposed to each other and are both in operational communication with channel 102 and are provided to deliver water that flows through primary water swivel 58, through water pipe 84 and through channel 102 of air swivel 60.

Figure 10:
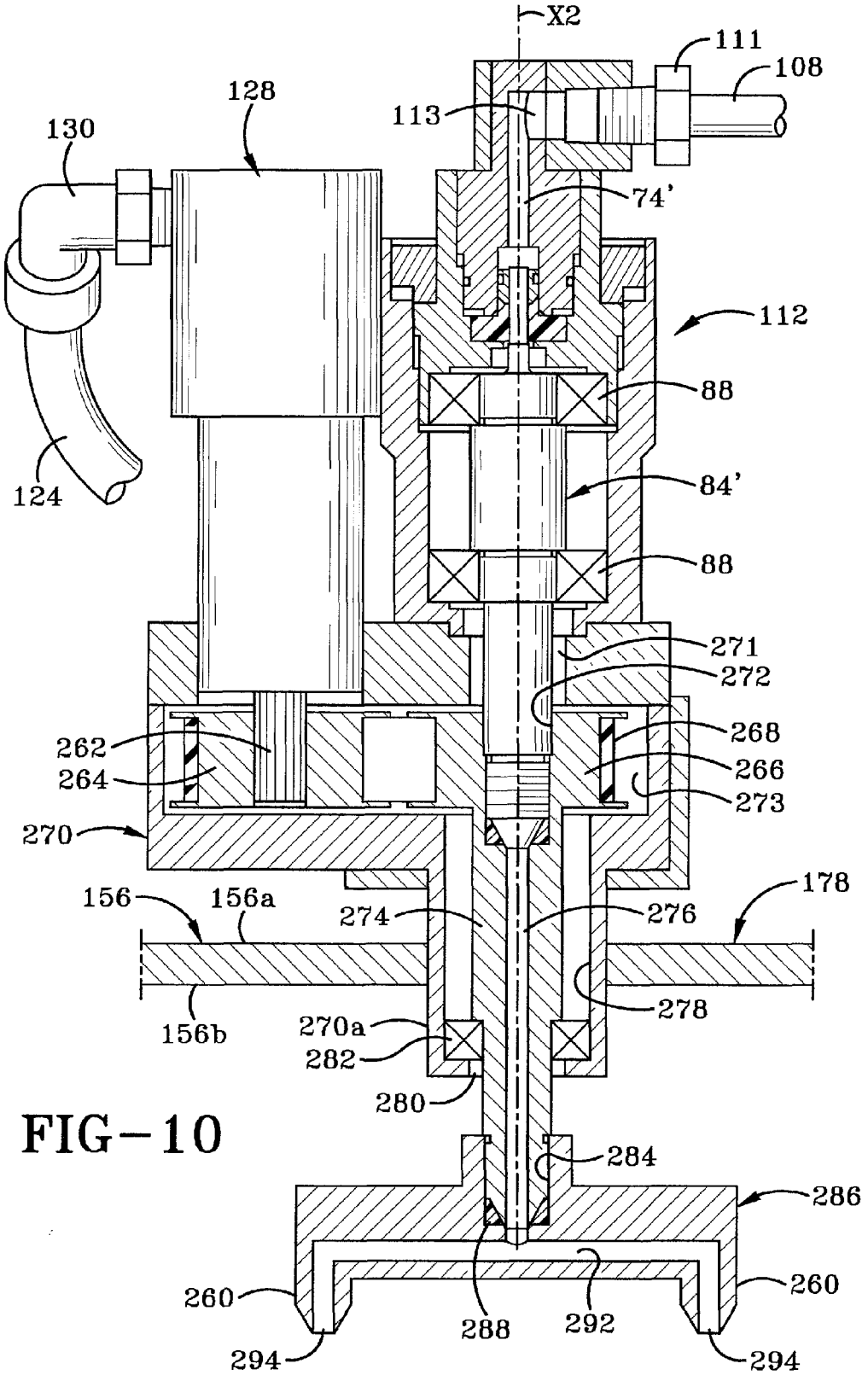
FIG. 10 is a cross-sectional view of the second motor assembly taken through line 10-10 of FIG. 5.

The nozzle assembly further includes a pair of secondary water swivels 112 and associated third motors 128. The air swivel 60 is operationally engaged with both of the secondary water swivels 112 and with the third motors 128. As seen in FIG. 10, secondary water swivels 112 are substantially identical in structure and function to primary water swivel 58 and include a rotatable pipe 84' that extends outwardly therefrom to engage a pulley as will be later described herein. Because of the substantially identical nature of secondary water swivel 112 to primary water swivel 58, secondary water swivel 112 will not be described further herein save to say that the swivel 112 defines a passageway 113 at the uppermost end of first bore 74' and a fitting 111 secures hose 108 to water swivel 112 so that passageway 113 provides fluid communication between hose 108 and first bore 74'. Water flows through water pipe 84 of primary water swivel 58 through channel 102 of air swivel, through passageway 103 (FIG. 9), through fittings 110, through pipes 108 and into secondary water swivels 112.

In accordance with another feature of the present invention, second region 90*b* of housing 90 defines a first passageway 114 that connects each of channels 100 and 104 to groove 98. A threaded plug 116 is disposed in the uppermost ends of each channel 100, 104. A thin plate 118 secured by bolts 120 to the upper end of housing 90 keeps plugs 116 in place. A second passageway 122 extends between a lowermost end of each channel 100, 104 and the exterior side surface of second region 90*b*. A pair of take-off air hoses 124 are connected to second region 90*b* by way of fittings 126. Air hoses 124 are opposed to each other and connect air swivel 60 to a pair of third motors 128. Fittings 130 connect hoses 124 to third motors 128.

In accordance with a specific feature of the present invention, an air hose 132 extends between air intake 64 and a manifold 134. Air hose 132 is secured to air intake 64 by a fitting 136 and to manifold 134 by a fitting 138. An air pipe 140 (FIG. 4) extends from air intake 64, through slot 56 in stabilizing assembly 54 and connects to a fitting 141 (FIG. 4) which is in fluid communication with a passageway (not shown) into groove 98 in first region 90*a* of housing 90.

In accordance with yet another feature of the present invention, a threaded post 143 extends outwardly and downwardly from a bottom end of second region 90*b* of housing 90. Post 143 extends through an aperture 144 (FIG. 9) defined in a U-shaped channel 146 and into engagement with an adjustment assembly 148. U-shaped channel 146 forms part of the nozzle assembly and includes a bottom wall 146*a* (FIG. 2) and side walls 146*b*, 146*c* which extend upwardly and outwardly from bottom wall 146*a* and generally at right angles thereto. Specifically, aperture 144 is defined in bottom wall 146*a* of channel 146 approximate midway between the first and second ends of the channel and approximate midway between side walls 146*b*, 146*c*. Adjustment assembly 148 comprises a generally circular member 148*a* and an insert 148*b*. Circular member 148*a* has a circumferential edge that is provided with a plurality of teeth 150 that extend outwardly away therefrom. This is best seen in FIG. 5. Circular member 148*a* defines a recess 152 therein and into which insert 148*b* is received. Insert 148*b* defines an aperture 154 therein and the wall defining aperture 154 is threaded, and insert is thereby threadably engaged with threaded post 143. The operator engages teeth 150 to rotate circular member 148*a* in a clockwise or counter-clockwise direction to move channel 146 toward or away from a disc plate 156, as will be hereinafter described.

Figure 11:
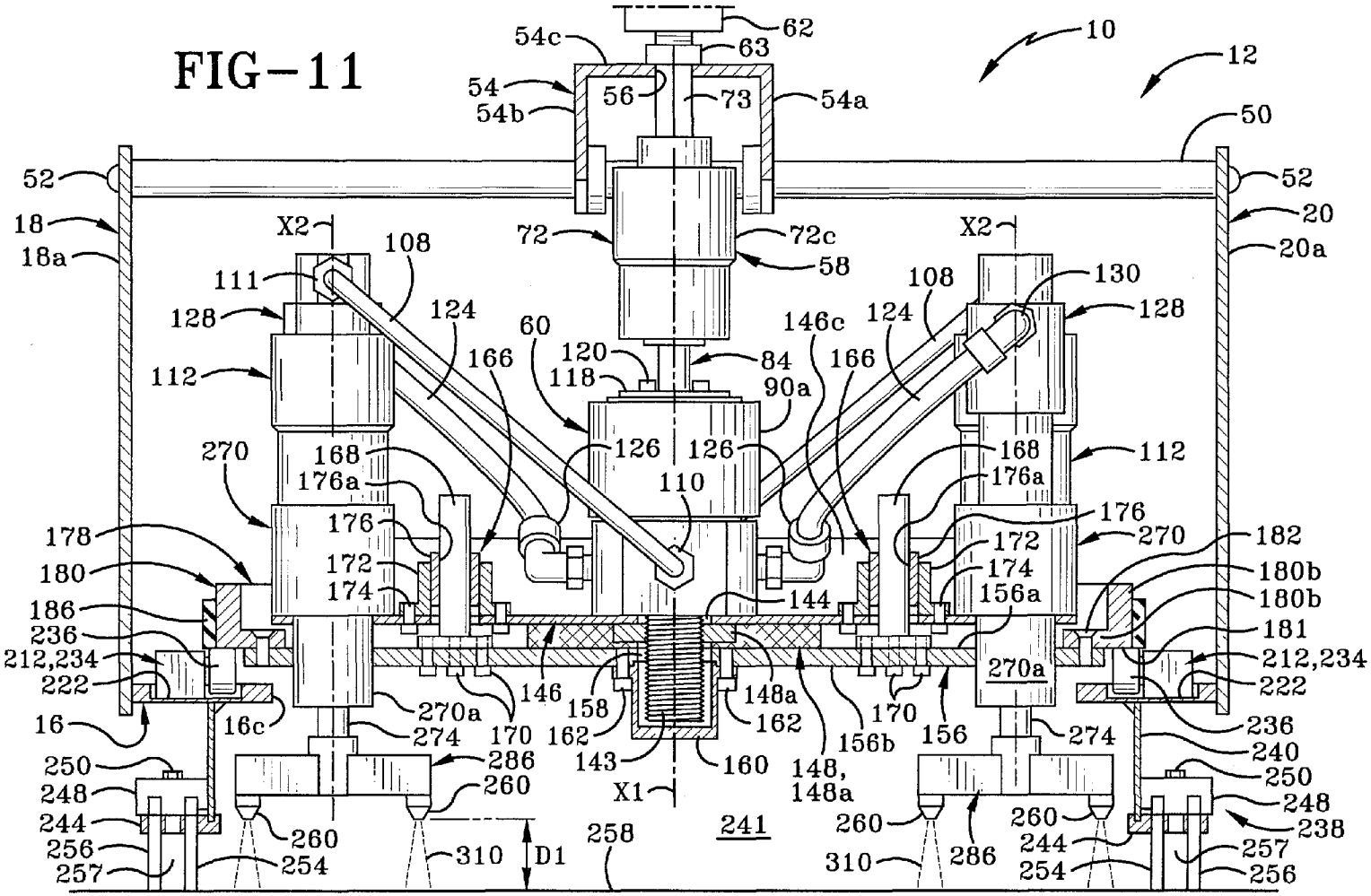
FIG. 11 is a rear view of the cleaning apparatus taken through line 11-11 of FIG. 2 showing the U-shaped channel and skirt in a first position.

As is evident from FIG. 11, disc plate 156 defines a central aperture 158 therein and through which threaded post 143 extends. A generally cylindrical cover 160 is secured to the lower surface 156*b* of disc plate 156 and is bolted thereto by way of bolts 162. Cover 160 defines an interior chamber 164 into which threaded post 143 is received.

Guide assemblies 166 are provided in U-shaped channel 146 on either side of air swivel 60. Guide assemblies 166 act to work with adjustment assembly to permit the distance between disc plate 156 and U-shaped channel 146 to be changed while still maintaining the alignment of disc plate 156 and channel 146. Each guide assembly 166 comprises a guide post 168 which is secured to the upper surface 156*a* of disc plate 156 by a plurality of bolts 170. Guide post 168 extends upwardly for a distance above upper surface 156*a* and is disposed generally at right angles thereto. A generally cylindrical guide housing 172 is secured to the upper surface of bottom wall 146*a* of U-shaped channel 146 by a plurality of bolts 174. A sleeve 176 is receivable in housing 172 and defines a bore 176*a* through which guide post 168 is received. One of housing 172 and sleeve 176 is rotatable relative to the other in a first direction to clampingly engage guide post 168 and prevent its movement, or is rotatable in a second direction so that guide post 168 is not clamped thereby and is free to move through bore 176*a*. Guide assemblies 166 must both be in a second position where guide posts 168 are free to move through bores 176*a* before adjustment assembly 148 may be engaged to change the distance between disc plate 156 and U-shaped channel 146. Guide assemblies 166 must both be in a first locked position where relative movement between guide post 168 and guide housing 172 is prevented, before apparatus 10 is activated, as will be hereinafter described.

In accordance with yet another specific feature of the present invention, disc plate 156 forms part of a disc plate assembly 178. Disc plate assembly 178 includes disc plate 156 and an annular ring 180 that is secured to disc plate 156 by bolts 182. As shown in various figures including FIG. 7, ring 180 preferably is generally L-shaped when viewed in cross-section and includes a horizontal leg 180*a* and a vertical leg 180*b*. Horizontal leg 180*a* is secured by bolts 182 to disc plate 156 and a plurality of teeth 184 extend radially outward from the circumferential edge of the vertical leg 180*b* of ring 180. A drive belt 186 (FIG. 2) having teeth 188 thereon is positioned to engage teeth 184 of disc plate assembly 178. Drive belt 186 passes around a pulley 190 (FIG. 5) which is fixedly secured to a drive shaft 192 of a second motor 194 (FIG. 2) which is mounted on a mounting block 195. Second motor 194 is provided to cause rotation in disc plate assembly 178 via pulley 190 and drive belt 186. Second motor 194 is air actuated and is connected via an air hose 196 to manifold 134. A fitting 198 secures air hose 196 to second motor 194.

As best seen in FIG. 2, adjustment valves 200 are provided on manifold 134 to regulate the flow of air through each of the air hoses 196 and 132. Manifold 134 is also connected to the main air hose 202 which extends between manifold 134 and a remote air supply 204 (FIG. 1). An air pressure sensor line 206 is also operationally engaged with manifold 134. Finally, an air hose 208 extends between manifold 134 and control valve 48.

As indicated previously, disc plate assembly 178 is rotated by second motor 194. In order to ensure that the rotation is smooth and the disc plate assembly is kept in the correct position during rotation, apparatus 10 is provided with a plurality of wheel assemblies 210, 212 that engage disc plate assembly 178. In the embodiment illustrated in FIG. 2, apparatus 10 includes four wheel assemblies 210 and three wheel assemblies 212.

Figure 7:
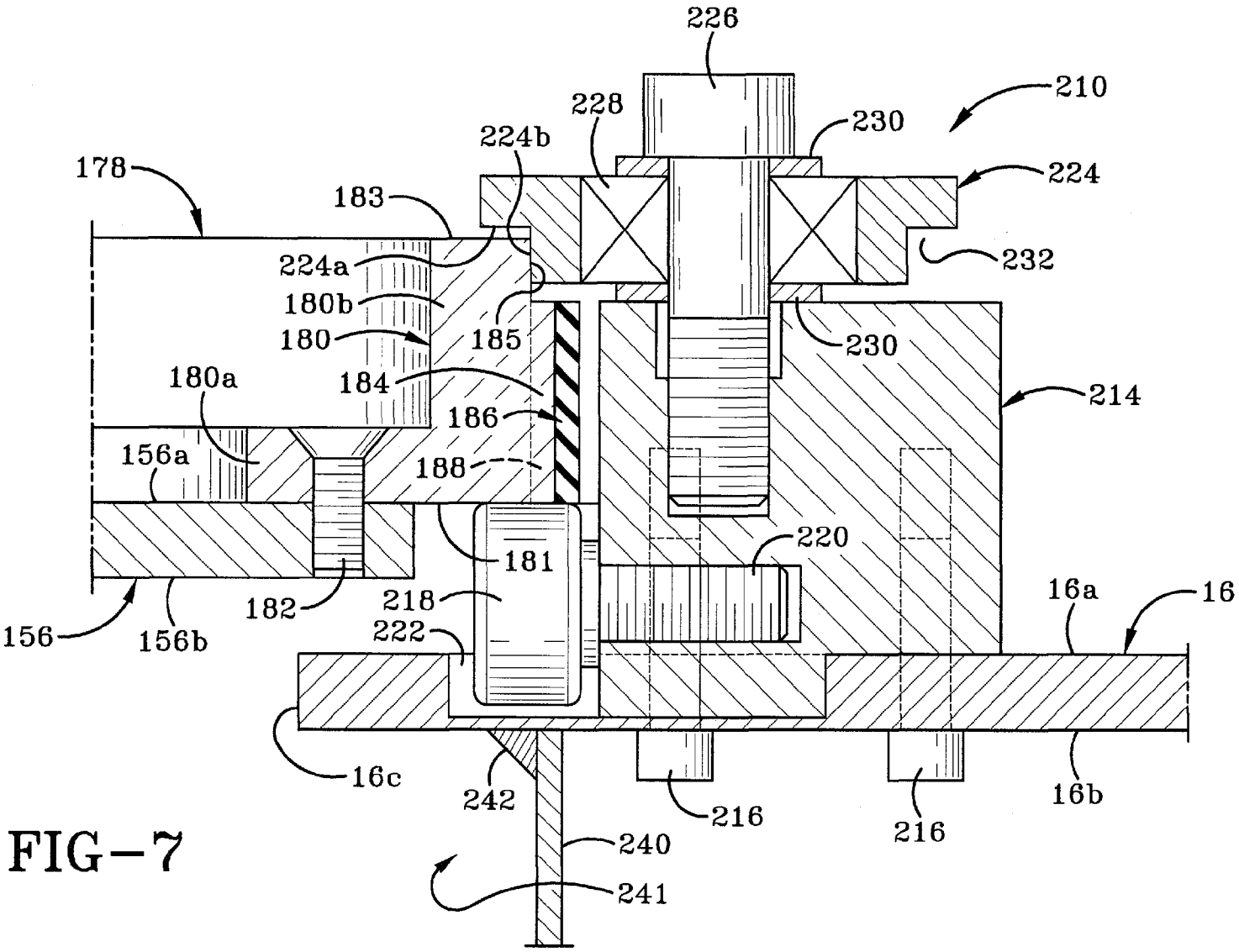
FIG. 7 is a cross-sectional view of the wheel assembly taken through line 7-7 of FIG. 5.
Figure 8:
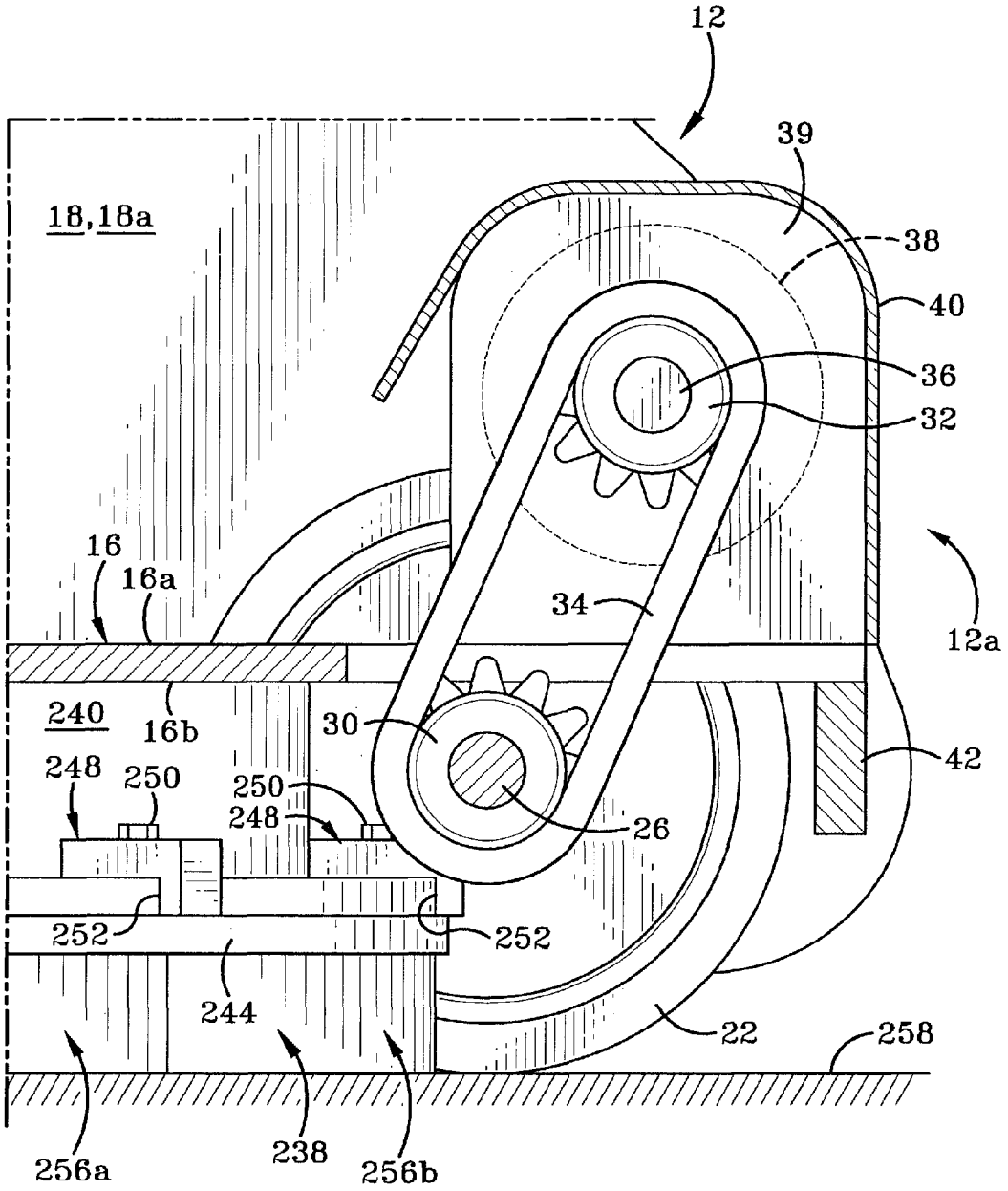
FIG. 8 is a cross-sectional view of the first and second gear sprockets and drive belt taken through line 8-8 of FIG. 5.
Figure 9:
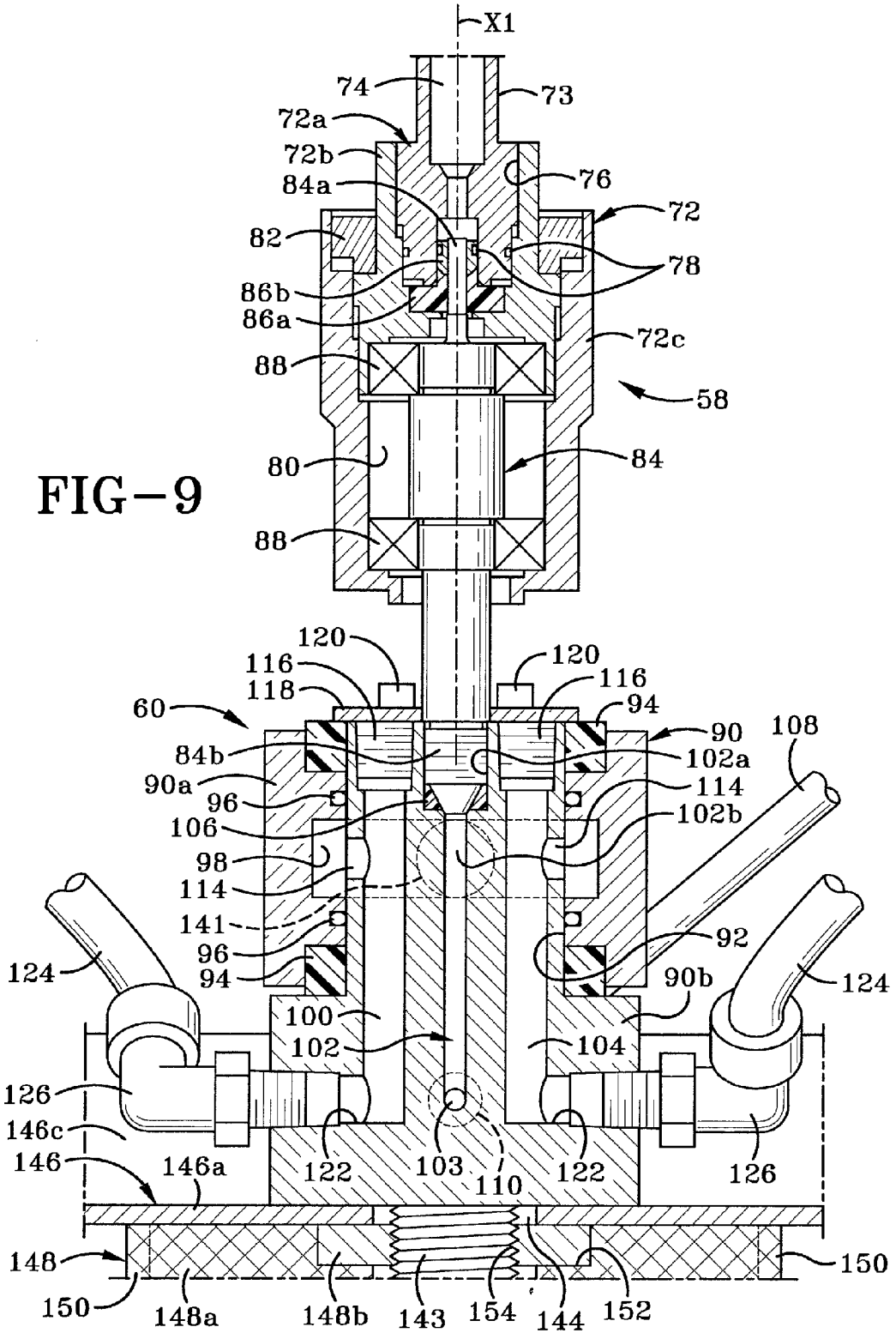
FIG. 9 is a cross-sectional view of the water swivel and air swivel taken through line 9-9 of FIG. 5.

Wheel assembly 210 is shown in greater detail in FIG. 7 and comprises a mounting block 214 that is bolted to base plate 16 by a plurality of bolts 216. Mounting block has a first wheel 218 mounted thereon by way of a threaded bolt 220. First wheel 218 is configured to rotate about a horizontal axis extending through bolt 220. As is evident from FIG. 7, preferably a recess 222 is defined in base plate 16 to accommodate first wheel 218. First wheel 218 also contacts the underside 181 of ring 180 of disc plate assembly 178. First wheel 218 also contacts the underside of the region of ring 180 that includes teeth 184 as well as the underside of drive belt 186. First wheel 218 acts to support underside 181, teeth 184 and drive belt 186 and substantially prevent them from moving downwardly toward base plate 16 as the disc plate assembly 178 rotates about a vertical axis.

Wheel assembly 210 also includes a second wheel 224 mounted to mounting block 214 by a threaded bolt 226. A bearing 228 and washers 230 are also provided to enable second wheel 224 to rotate about a vertical axis that extends through bolt 226. Second wheel 224 defines an annular L-shaped groove 232 bounded by a horizontal face 224*a* and a vertical face 224*b*. Horizontal face 224*a* is disposed a short distance above the upper end 183 of ring 180 and vertical face 224*b* is disposed in abutting contact with the side edge 185 of ring 180 that extends above teeth 184. Second wheel 224 therefore aids in keeping disc plate assembly 178 from moving laterally as it rotates about a vertical axis and keeps disc plate assembly 178 from drifting upwardly as it rotates. Both of the first and second wheels 218, 224 rotate because of contact with the rotating disc plate assembly 178.

Wheel assembly 212 is shown in greater detail in FIG. 11. Wheel assembly 212 comprises a mounting block 234 having a single wheel 236 mounted for rotation about a horizontal axis. Wheel 236 is received in a recess of base plate 16 and contacts the underside 181 of ring 180 of disc plate assembly 178 and of drive belt 186. Each wheel assembly 212 therefore aids in preventing disc plate assembly 178 from drifting downwardly at the edges as it rotates about a vertical axis "X" (FIG. 11).

Cleaning apparatus 10 further includes a skirt assembly 238 that extends downwardly from base plate 16. A wall 240 is welded by a weld 242 to a lower surface 16*b* of base plate 16 and extends vertically downward therefrom. A support wall 244 extends horizontally outwardly from a bottom end of wall 240 and is welded thereto. Wall 244 defines a pair of vertically extending slots 246 therethrough. A mounting block 248 is secured to wall 244 by a bolt 250 that extends through a hole 249 in mounting block 248 and through a threaded hole 245 in support wall 244. Mounting block 248 defines two vertically extending recesses 252 therein, each recess 252 being configured to align with one of slots 246 in wall 244. A first skirt 254 is anchored in a first recess 252 and extends downwardly through the associated slot 246 and a second skirt 256 is anchored in the second recess 252 and extends downwardly through the associated slot 246. First and second skirts 254, 256 may be comprised of brushes, bristles and/or rubber filaments. Mounting block 248 and bolt 250 are combined in a loose fit in order to permit first and second skirts 254, 256 to "float" according to deviations in the surface being cleaned. This feature allows for a continual seal on apparatus 10 for deflection of debris and vacuum containment.

First and second skirts 254, 256 are disposed so as to contact a surface 258 to be cleaned by apparatus 10. A gap 257 is defined between first and second skirts 254, 256. As can be seen from FIG. 3, each of first and second skirts 254, 256 is comprised of a plurality of skirt segments, such as skirt segments 254*a*, 254*b*, 254*b* and 256*a*, 256*b*, 256*c* that are disposed in end-to-end relationship. The skirt segments are arranged so as to form a circular skirt that extends downwardly from the circumferential edge of the disc plate 156 to contact the surface 258 to be cleaned. First and second skirts 254, 256 perform a series of functions. Firstly, they act as scouring agents to clean and scrub surface 258 which they contact. Secondly, the skirts 254, 256 substantially prevent water or cleaning fluid delivered through nozzles 260 from squirting out of apparatus. The fact that first and second skirts 254, 256 are in sections makes it possible for portions of the skirts to flex and move in different directions relative to each other as apparatus 10 travels over surface 258. Gap 257 provides a region into which the one of the skirts can flex and move without interfering with the other skirt. It will be understood that a single skirt could be used instead of the first and second skirts 254, 256. It will further be understood that more than two skirts could be utilized without departing from the scope of the invention. In this latter instance, a gap would preferably be defined between adjacent skirts.

Nozzles 260 are provided at the lower ends of the secondary water swivels 112 as is shown in FIG. 10. Each third motor 128 has a drive shaft 262 extending outwardly from its bottom end. Drive shaft 262 is operationally engaged with a first pulley 264 which in turn is linked to a second pulley 266 by a drive belt 268. First and second pulleys 264, 266 are mounted side by side in chamber 273 in a mounting block 270. Secondary water swivel 112 is disposed adjacent third motor 128 and the water pipe 84' extends outwardly from the bottom end of water swivel 112, through an opening 271 in mounting block 270, and is operationally engaged in an aperture 272 in second pulley 266. Second pulley 266 includes an elongate stem 274 which defines a channel 276 therethrough. Water pipe 84' is in fluid communication with channel 274. Stem 274 extends downwardly through a chamber 278 defined in mounting block 270 and outwardly therefrom through an aperture 280 in a lower end of mounting block 270. A bearing 282 is disposed between stem 274 and an interior wall 270*a* of mounting block 270 that defines chamber 278. The terminal end of stem 274 is received in an aperture 284 of a nozzle head 286. A seal 288 is provided to prevent leakage of water from channel 276. Nozzle head 286 is provided with a channel 292 that is in fluid communication with channel 276 of stem 274. An opening 294 to channel 292 is provided in the lowermost end of each nozzle 260.

In accordance with a specific feature of the present invention, third motor 128 rotates drive shaft 262 about a vertical axis. Drive shaft 262 rotates first pulley 264, thereby causing drive belt 268 to rotate. Movement of drive belt 268 causes a rotational motion of second pulley 266 about a vertical axis. Since water pipe 84' is operationally engaged with second pulley 266, the rotation of second pulley 266 causes water pipe 84' to rotate about the same vertical axis. Finally, since water pipe 84' is operationally engaged with nozzle head 286, nozzle head 286 rotates in unison with water pipe 84'. Thus, water delivered through water swivel 112, through water pipe 84' and through nozzles 260 is sprayed in a circular pattern onto surface 258. At the same time, disc plate assembly 178 rotates about a vertical axis. Consequently, the rotating nozzles 260 are themselves rotated about a central vertical axis by the rotating disc plate assembly 178 so that a circular area of surface 258 is subjected to water jetting out of nozzles 260. At the same time, the cleaning apparatus 10 is moved in a linear fashion over surface 258 thus bringing a new region of the surface still to be cleaned into the area defined by first and second skirts 254, 256.

It may be desirable to periodically suck the cleaning fluid or water out of washing chamber 241 (FIG. 11) and off of the surface 258 after it has been cleaned. To that end, cleaning apparatus 10 is provided with a vacuum port 296 in vertical wall 240. A vacuum hose 298 may then be connected to a remote vacuum 300. If the operator does not wish to vacuum up dirty cleaning fluid, the vacuum port 296 may be closed off with a cap (not shown).

Handle 14 is mounted to upper surface 17*a* of upper base plate 17 by way of mounting plate 302 (FIG. 2) and a plurality of bolts 304. Handle 14 extends outwardly from housing 12 at an angle of about 45 degrees, although this angle may be adjustable. Handle 14 includes a T-shaped cross-bar 16 that may be telescoped outwardly so that the position of the upper end 14*a* of handle 14 can be adjusted to suit different height operators. This adjustability is indicated by arrow "A1" on FIG. 1. A trigger 306 is provided on handle 14 to actuate cleaning apparatus 10. Additionally, control lever 308 is operationally engaged with control valve 48 and is movable, as indicated by arrow "A2" to adjust the pressure delivered through air hoses 44, 46, 208.

Figure 12:
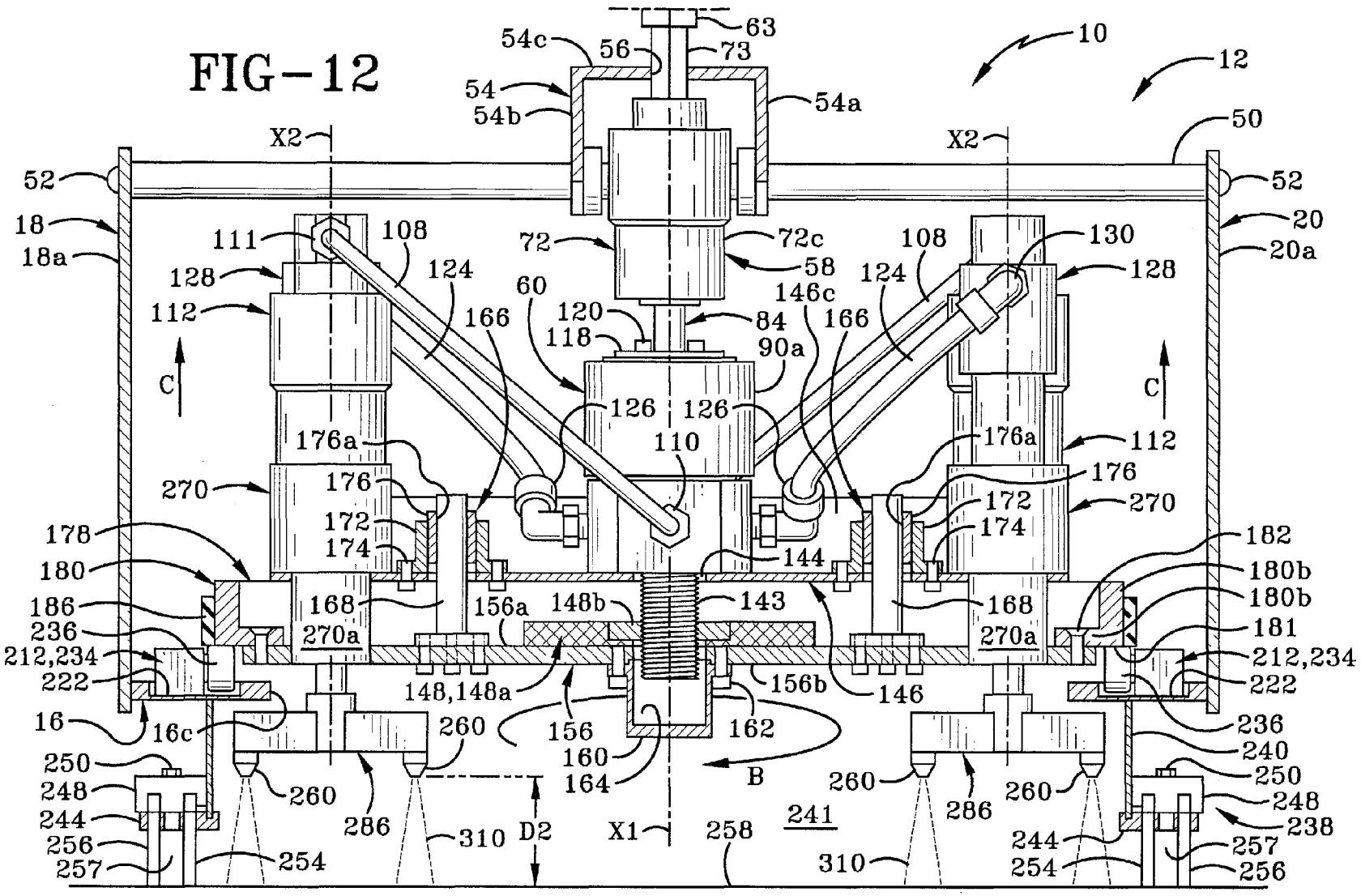
FIG. 12 is a rear view of the cleaning apparatus taken through line 11-11 of FIG. 2 showing the U-shaped channel and skirt in a second position.

FIGS. 11 and 12 show the manner in which the distance between nozzles 260 and surface 258 may be adjusted. FIG. 11 shows nozzles 260 at a first distance "D1" from surface 258. In this instance, bottom wall 146*a* of U-shaped channel 146 is in abutting contact with adjustment assembly 148. The operator will then unlock guide assemblies 166 so that U-shaped channel 146 is free to move relative to disc plate 156. The operator will engage the knurling or teeth 150 on adjustment member 148 and will rotate adjustment member in a first direction. The rotation of adjustment member 148 will cause insert 148*b* to move one of upwardly or downwardly along threaded post 143, thereby causing post 143 to move vertically upward through chamber 164 of cover 160. This upwardly movement of post 143 causes the entire U-shaped channel 146 and all the components engaged therewith to move upwardly as indicated by arrow "C" in FIG. 12. This upward motion increases the distance between nozzles 260 and surface 258 to a second height "D2". The adjustment assembly 148 can be rotated in the opposite direction to decrease the distance between nozzles 260 and surface 258. The operator can therefore set the nozzles 260 at any one of a desired range of heights relative to surface 258 so that the water jets 310 spraying out of nozzles 260 will cover the desired area on surface 258.

Cleaning apparatus 10 is used in the following manner. When it is desired to clean surface 258 the operator grasps bar 15 at top end 14*a* of handle 14 and increases or decreases the length of handle 14 as needed by moving bar 15 toward or away from lower end 14*b* as indicated by arrow "A1" (FIG. 1). Although it is not illustrated herein, it will be understood that handle 14 preferably is provided with a locking mechanism to lock the handle 14 at the adjusted height. The operator then engages trigger 306 to cause air from air source 204 to flow through main air hose 202 and into manifold 134. From there, air is directed through several different hoses to activate the various motors in apparatus 10. Firstly, air flows from manifold 134 through air hose 208, through control valve 48, through one of hoses 44, 46 to first motor 38, and back through the other of hoses 44, 46 to control valve 48. The airflow actuates first motor 38 which rotates drive shaft 36 (FIG. 8) thereby turning second gear sprocket 32, which turns drive belt 34, which rotates first gear sprocket 30 which rotates wheels 22 about axel 26. As wheels 22 turn, cleaning apparatus 10 is moved linearly across surface 258. (It will be understood that the apparatus 10 may be pushed "free wheel" over the surface by disengaging first gear sprocket 30.) Trigger 306 preferably is capable of being activated to cause cleaning apparatus 10 to move in either of a forward and rearward direction across surface 258 by simply reversing the flow of air through the system of hoses attached to first motor 38. Sensor 206 is provided to detect the air pressure in the airflow system and control lever 308 is moved as indicated by arrow "A2" to adjust the air pressure being delivered through the various hoses.

Figure 3:
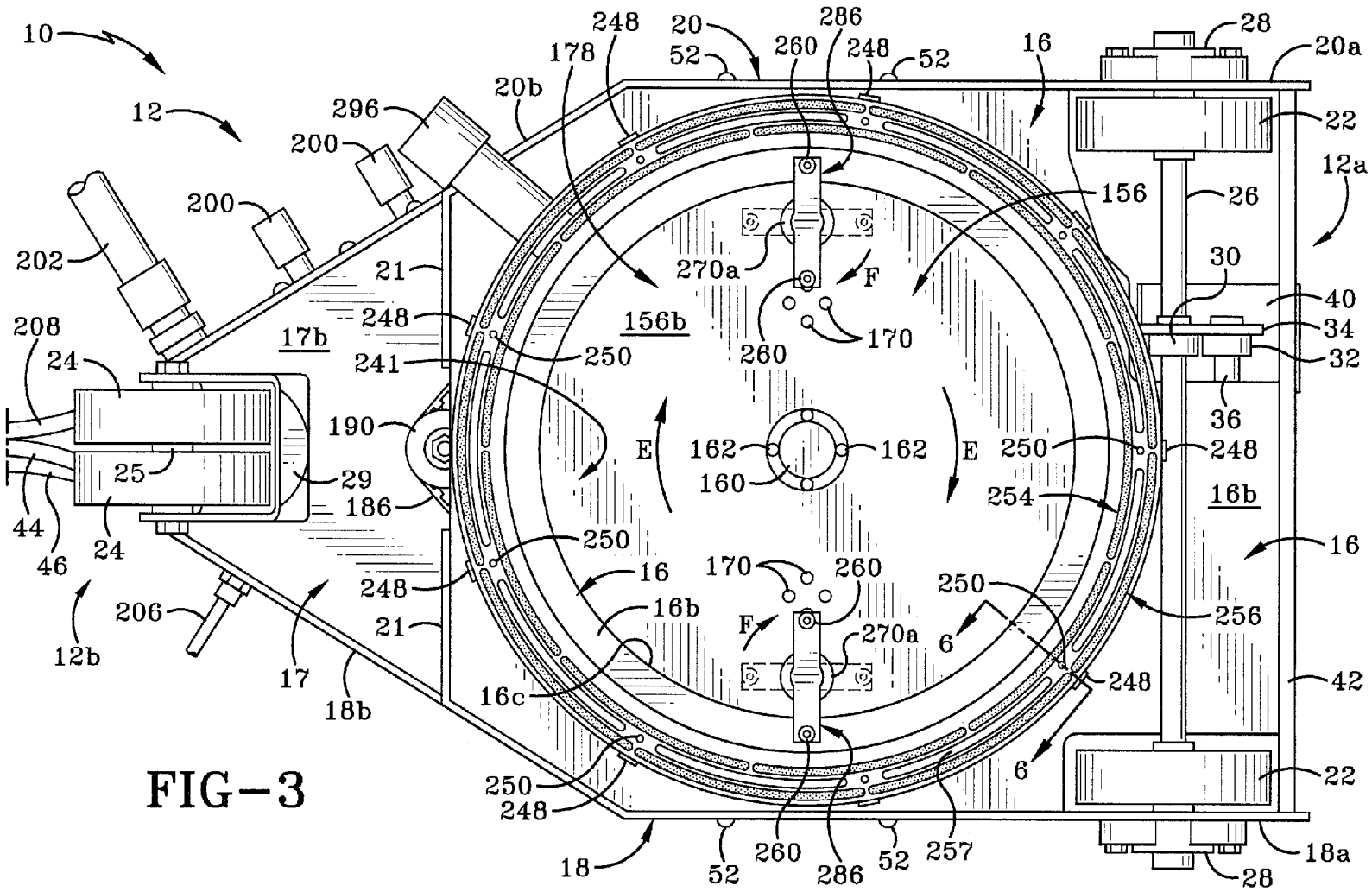
FIG. 3 is a bottom view of the cleaning apparatus as shown in FIG. 2.
Figure 4:
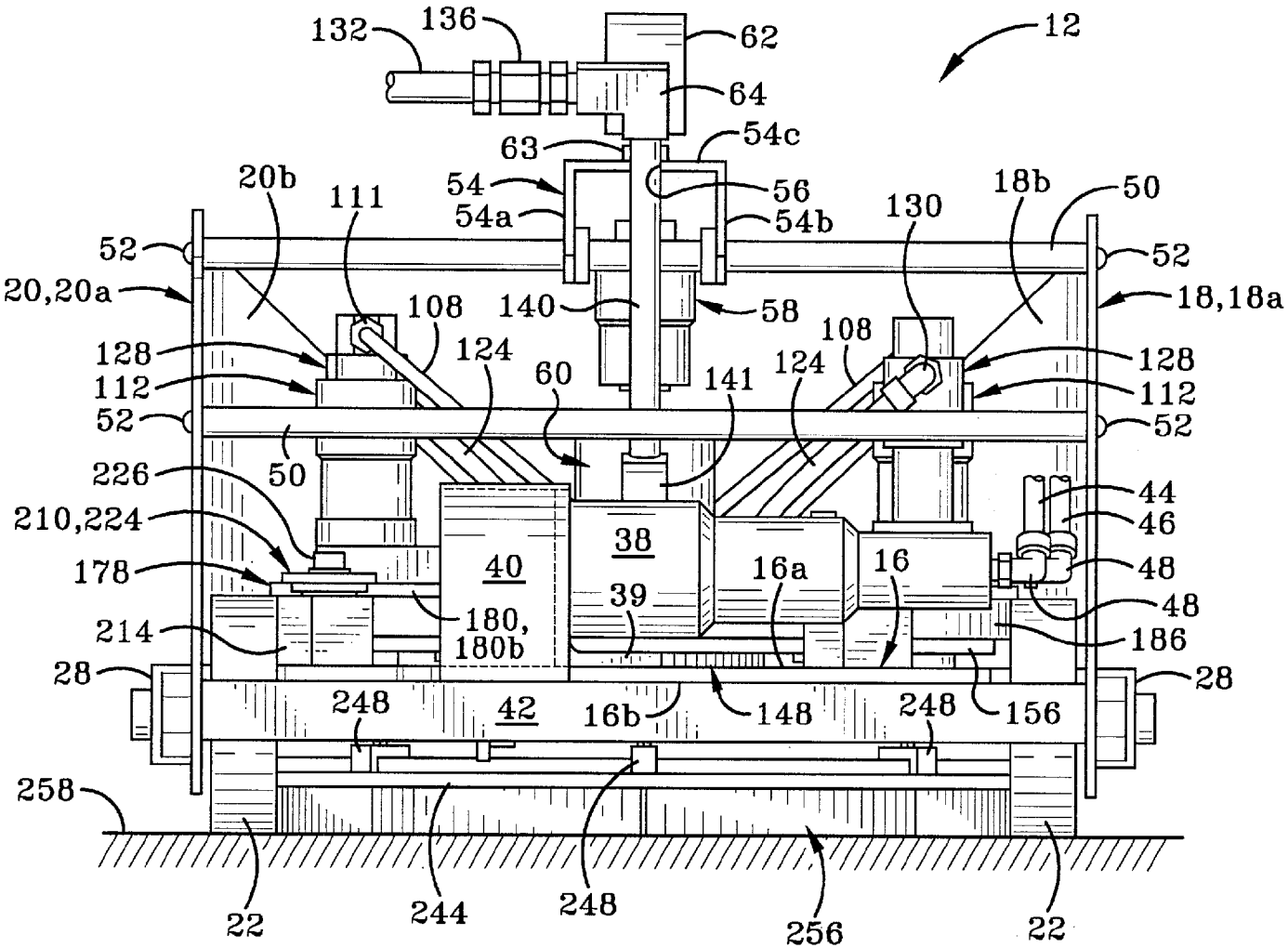
FIG. 4 is a front view the cleaning apparatus as shown in FIG. 2.

Referring to FIG. 2, activation of trigger 306 also causes air to flow from manifold 134 through hose 196 to second motor 194 The airflow activates second motor 194 causing it to rotate drive shaft 192 (FIG. 5) about a vertical axis. Drive shaft 192 is engaged with pulley 190 and as drive shaft 192 rotates it causes pulley 190 to rotate. Pulley 190 moves drive belt 186 which in turn causes rotation of disc plate assembly 178 about a first vertical axis "X1" (FIG. 9) and in the direction of arrow "E" (FIG. 3).

Still referring to FIG. 2, activation of trigger 306 also causes air to flow from manifold 134 through hose 132, through air inlet 64, through air pipe 140 (FIG. 4), through fitting 141 (FIGS. 4 & 9) and into groove 98 in air swivel 60. Air then flows through channels 100 and 104 into hoses 124 and into third motors 128 (FIG. 10). The airflow activates third motors 128 causing them to each rotate their drive shaft 262 about a vertical axis. The drive shaft 262 rotates first pulley 264 about a vertical axis aligned with drive shaft 262. The rotation of first pulley 264 moves drive belt 268 which in turn causes rotation of second pulley 266 about a second vertical axis "X2" (FIG. 10). Since second pulley 266 is fixedly engaged with pipe 84' of secondary water swivel 112, the rotation of second pulley 266 causes pipe 84' to rotate about second vertical axis "X2". Stem 274 of second pulley 266 is also fixedly engaged with nozzle head 286. Consequently, when second pulley 266 rotates about second vertical axis "X2", nozzle head 286 also rotates in unison with second pulley 266 about second vertical axis "X2" and in the direction of arrow "F" (FIG. 3).

Since third motors 128 and water swivels 112 are mounted on U-shaped channel 146 which is engaged with disc plate assembly 178, as disc plate assembly 178 rotates in the direction of arrow "E", the entire U-shaped channel 146 rotates in unison with disc plate assembly 178 in the direction of arrow "E". Simultaneously, the nozzle heads 286 are rotating in the direction of arrow "F". This combination motion is illustrated in FIG. 3. The disc plate assembly 178 rotates through 360° at a first slower speed and each nozzle head 286 rotates through 360° at a second substantially faster speed. Preferably, disc plate assembly 178 rotates at a first speed in a range of from 5 rpm to 100 rpm while nozzle heads 286 rotate at a second speed in a range of from 700 rpm to 6000 rpm.

Actuation of trigger 306 also causes water to flow from water source 70 through main water hose 66 through water inlet 62 and into channel 74 (FIG. 9) of primary water swivel 58. Water flows through channel 74, through the bore of pipe 84 and into channel 102 of air swivel 60. From channel 102, water flows through horizontal passageway 103, through fitting 110, through take-off pipes 108 and into channels 74' of secondary water swivels 112. Water flows from channels 74' through pipes 84', through channels 276, through channel 292 in nozzle heads 286 and out of openings 294. A water jet 310 exits openings 294 and sprays onto surface 258 to be cleaned. Since nozzle heads 286 are rotating at the same time that the water jets 310 are exiting from openings 294 in nozzles 260, water jets 310 are rotated at the higher second speed through 360°, thus cleaning a larger surface that would be possible if nozzle heads 286 were not rotating. Preferably, water is delivered through this water flow system under pressure so that the rapidly rotating water jets 310 both wash and scour surface 258. First and second skirts 254, 256 aid in scouring surface 258 while keeping water from jets 310 from spraying outwardly from the underside of apparatus 10. As indicated previously, a vacuum system 300 may be selectively engaged on vacuum port 296 to suction dirty water from inside washing chamber 241. As has been previously described herein the distance between nozzles 260 and surface 258 is adjustable by engaging the adjustment assembly 148.

It will be understood that if the apparatus 10 is to be used to clean walls, ceilings, ship hulls and the like, the handle 14 would be removed and the apparatus 10 would be attached to the surface to be cleaned by vacuum.

Furthermore, it will be understood that the exact configuration of the type of nozzle used in the apparatus 10 may be changed to suit the type of substance that is to be removed from the surface to be cleaned.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A method of cleaning a surface comprising the steps of: providing a cleaning apparatus including a frame having a front end and a back end; a plurality of wheels mounted on the frame; a disc plate assembly mounted on the frame; and a nozzle assembly mounted on the disc plate assembly;

activating the cleaning apparatus;

rotating the wheels about a horizontal axis so as to move the cleaning apparatus linearly over a surface to be cleaned;

rotating the disc plate assembly about a first vertical axis;

rotating a nozzle head on the nozzle assembly about a second vertical axis that is different from the first vertical axis, wherein a first motor rotates the nozzle head;

channeling fluid from a fluid source through a fluid swivel connected to the first motor such that fluid channeled through the fluid swivel powers the rotation of the nozzle head;

channeling water from a water source through a water swivel connected to the nozzle assembly such that water channeled through the water swivel is sprayed from the nozzle head; and wherein the fluid swivel and water swivel are positioned on the first vertical axis.

2. The method as defined in claim 1, further comprising the steps of:

rotating the disc plate assembly at a first speed and rotating the nozzle head at a second speed, where the second speed is higher than the first speed.

3. The method as defined in claim 1, further comprising the step of adjusting a position of the nozzle head up or down relative to the disc plate assembly and thereby adjusting a distance between the nozzle head and the surface to be cleaned.

4. The method as defined in claim 3, wherein the step of adjusting the position of the nozzle head further comprises:

rotating an adjustment member in one direction to move the nozzle assembly and thereby the nozzle head closer to the surface to be cleaned and rotating the adjustment member in an opposite direction to move the nozzle assembly and thereby the nozzle head further from the surface to be cleaned.

5. The method as defined in claim 4, further comprising;

extending a threaded post outwardly from a first surface of the nozzle assembly;

providing the adjustment member on the disc plate assembly;

engaging the adjustment member with the post;

rotating the adjustment member in a first direction about the post and thereby moving the nozzle assembly away from the disc plate assembly or rotating the adjustment member in a second direction about the post and thereby moving the nozzle assembly toward the disc plate assembly.

6. The method as defined in claim 5, further comprising maintaining an alignment of the disc plate assembly relative to the nozzle assembly while selectively rotating the adjustment member in either of the first and second directions.

7. The method as defined in claim 6, wherein the step of maintaining the alignment of the disc plate assembly relative to the nozzle assembly further comprises:

providing a guide post extending outwardly from the disc plate assembly;

aligning the guide post with a bore of a sleeve provided on the nozzle assembly; and keeping at least a portion of the guide post within the bore of the sleeve while rotating the adjustment member in either of the first and second directions.

8. The method as defined in claim 7, further comprising selectively clamping the guide post within the bore of the sleeve and substantially preventing movement of the guide post within the bore of the sleeve.

9. The method as defined in claim 8, further comprising selectively releasing the guide post that was previously clamped and moving the guide post within the bore of the sleeve.

10. The method as defined in claim 8, further comprising rotating the adjustment member only when the guide post is clamped within the bore of the sleeve.

11. The method as defined in claim 9, further comprising only actuating the cleaning apparatus to clean the surface when the guide post is free to move through the bore of the sleeve.

12. The method as defined in claim 1, wherein the step of rotating the wheels includes delivering fluid from a remote fluid source to a second motor mounted on the frame and activating the second motor to rotate the wheels about the horizontal axis.

13. The method as defined in claim 1, wherein the step of rotating the disc plate assembly includes delivering fluid from a remote source to a third motor mounted on the frame and activating the third motor to rotate the disc plate assembly about the first vertical axis.

14. The method as defined in claim 1, wherein the step of rotating the wheels includes delivering fluid from a remote fluid source to a second motor mounted on the frame to rotate the wheels about the horizontal axis; wherein the step of rotating the disc plate assembly includes delivering fluid from a remote fluid source to a third motor mounted on the frame to rotate the disc plate assembly about the first vertical axis; and further comprising the step of activating one or more of the first, second and third motors.

15. The method as defined in claim 14, further comprising the steps of:

sensing a pressure of fluid flowing through a fluid delivery system to the first, second and third motors; and adjusting the pressure of flowing fluid to change the speed of rotation of one or more of the disc plate assembly, the wheels and the nozzle head.

16. The method as defined in claim 1, further comprising the step of:

keeping the apparatus proximate the surface to be cleaned by way of a vacuum.

17. The method as defined in claim 1, further comprising:

providing a plurality of nozzle heads on the nozzle assembly;

providing a skirt assembly on the disc plate assembly, where the skirt assembly encircles the plurality of nozzle heads;

defining a chamber bounded by the skirt assembly and the surface to be cleaned; and suctioning fluids out of the chamber using a vacuum source.

18. The method as defined in claim 17, wherein the step of providing the skirt assembly includes providing a plurality of bristle members that extend downwardly from a portion of the disc plate assembly toward the surface to be cleaned; and the method further includes moving the bristle members and scrubbing the surface to be cleaned using the moving bristle members.

19. The method as defined in claim 1, wherein the step of channeling water includes delivering the water under pressure.

* * * * *